US010672331B2

(12) United States Patent
Kim et al.

(10) Patent No.: US 10,672,331 B2
(45) Date of Patent: Jun. 2, 2020

(54) DISPLAY DEVICE AND METHOD OF DRIVING THE SAME

(71) Applicant: Samsung Display Co., Ltd., Yongin-si, Gyeonggi-do (KR)

(72) Inventors: Hyun Woong Kim, Yongin-si (KR); Jong Won Park, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 115 days.

(21) Appl. No.: 15/847,471

(22) Filed: Dec. 19, 2017

(65) Prior Publication Data

US 2018/0293938 A1 Oct. 11, 2018

(30) Foreign Application Priority Data

Apr. 6, 2017 (KR) ..... 10-2017-0044892

(51) Int. Cl.

| | |
|---|---|
| ***G09G 3/3225*** | (2016.01) |
| ***G09G 3/3266*** | (2016.01) |
| ***G09G 3/3233*** | (2016.01) |
| ***G09G 3/00*** | (2006.01) |
| *G09G 3/3275* | (2016.01) |

(52) U.S. Cl.

CPC ..... *G09G 3/3225* (2013.01); *G09G 3/003* (2013.01); *G09G 3/3233* (2013.01); *G09G 3/3266* (2013.01); *G09G 3/3275* (2013.01); *G09G 2300/0819* (2013.01); *G09G 2300/0842* (2013.01); *G09G 2300/0861* (2013.01); *G09G 2310/0251* (2013.01);

(Continued)

(58) Field of Classification Search

CPC ... G09G 2300/0819; G09G 2300/0842; G09G 2300/0861; G09G 2310/0251; G09G 2310/0262; G09G 2320/02; G09G 2330/021; G09G 3/003; G09G 3/3225; G09G 3/3233; G09G 3/3266; G09G 3/3275

See application file for complete search history.

(56) References Cited

U.S. PATENT DOCUMENTS

| | | | | |
|---|---|---|---|---|
| 9,230,480 | B2 | 1/2016 | Park | |
| 2011/0227885 | A1* | 9/2011 | Chung | G09G 3/3241 345/204 |

(Continued)

FOREIGN PATENT DOCUMENTS

| | | | |
|---|---|---|---|
| KR | 10-2015-0011661 | A | 2/2015 |
| KR | 10-1674606 | B1 | 11/2016 |
| KR | 10-2017-0004816 | A | 1/2017 |

*Primary Examiner* — Viet D Pham

(74) *Attorney, Agent, or Firm* — Lewis Roca Rothgerber Christie LLP

(57) ABSTRACT

Provided herein may be a display device and a method of driving the display device. The display device may include pixels including first pixels and second pixels in a pixel area, scan lines coupled with the pixels, and configured to supply scan signals to the pixels, a first emission control line coupled to the first pixels, and configured to supply a first emission control signal to the first pixels, a second emission control line coupled to the second pixels, and configured to supply a second emission control signal to the second pixels, and a display driver configured to supply the first emission control signal to the first emission control line before supplying the second emission control signal to the second emission control line.

15 Claims, 5 Drawing Sheets

(52) U.S. Cl.
CPC . *G09G 2310/0262* (2013.01); *G09G 2320/02* (2013.01); *G09G 2330/021* (2013.01)

(56) References Cited

U.S. PATENT DOCUMENTS

| | | | | |
|---|---|---|---|---|
| 2012/0044240 | A1 | 2/2012 | Chung et al. | |
| 2012/0105496 | A1* | 5/2012 | Komiya | G09G 3/003 345/690 |
| 2012/0139820 | A1* | 6/2012 | Senda | G09G 3/003 345/76 |
| 2012/0147060 | A1* | 6/2012 | Jeong | G09G 3/3233 345/690 |
| 2013/0208032 | A1* | 8/2013 | Jang | G09G 3/3233 345/694 |
| 2015/0170576 | A1* | 6/2015 | Bae | G09G 3/3225 345/205 |
| 2016/0293079 | A1* | 10/2016 | Kim | G09G 3/3233 |

* cited by examiner

DISPLAY DEVICE AND METHOD OF DRIVING THE SAME

CROSS-REFERENCE TO RELATED APPLICATION

This application claims priority to, and the benefit of, Korean patent application no. 10-2017-0044892 filed in the Korean Intellectual Property Office on Apr. 6, 2017, the entire disclosure of which is incorporated herein in its entirety by reference.

BACKGROUND

1. Field

Various embodiments of the present disclosure relate to a display device and a method of driving the display device.

2. Description of Related Art

An organic light-emitting display device includes two electrodes and an organic light-emitting layer therebetween. In the organic light-emitting display device, electrons injected from one of the two electrodes, and holes injected from the other electrodes, are combined with each other in the organic light-emitting layer so that excitons are generated, and so that light is emitted by energy emission of the excitons.

The organic light-emitting display device includes a plurality of pixels, each of which includes an organic light-emitting element that is a self-emissive element. Each pixel is coupled with lines formed to provide various signals to the pixel. The lines provide signals to each pixel in various manners.

SUMMARY

Various embodiments of the present disclosure are directed to a display device having improved display quality.

An embodiment of the present disclosure provides a display device including pixels including first pixels and second pixels in a pixel area, scan lines coupled with the pixels, and configured to supply scan signals to the pixels, a first emission control line coupled to the first pixels, and configured to supply a first emission control signal to the first pixels, a second emission control line coupled to the second pixels, and configured to supply a second emission control signal to the second pixels, and a display driver configured to supply the first emission control signal to the first emission control line before supplying the second emission control signal to the second emission control line.

The first emission control signal may be configured to be concurrently or substantially simultaneously supplied to the first pixels, and wherein the second emission control signal is configured to be concurrently or substantially simultaneously supplied to the second pixels.

The display driver may be configured to supply the first emission control signal to the first emission control line after the scan signals are supplied to the first and second pixels.

The display device may further include an initialization control line coupled to the pixels, and configured to supply an initialization control signal to the pixels via the initialization control line such that an initialization power is supplied to anode electrodes of organic light-emitting diodes in the pixels.

The display driver may be configured to supply the initialization control signal to the initialization control line after the scan signals are supplied to the pixels.

The display driver may be configured to supply the first emission control signal to the first emission control line after the initialization control signal is supplied to the initialization control line.

The display driver may be configured to supply the first and second emission control signals such that a portion of a low level section of the first emission control signal overlaps a low level section of the second emission control signal.

The first emission control line may include a first sub-line coupled with the display driver and extending in a first direction, and second sub-lines coupled to the first sub-line and extending in a second direction crossing the first direction, and the second emission control line may include a third sub-line coupled with the display driver and extending in the first direction, and fourth sub-lines coupled to the third sub-line and extending in the second direction, wherein the first sub-line is on a first side of the pixel area, and wherein the third sub-line is on a second side of the pixel area that is opposite to the first side.

The second sub-lines and the fourth sub-lines may be arranged alternately along the first direction.

A number of second sub-lines may be equal to a number of fourth sub-lines.

An embodiment of the present disclosure provides a method of driving a display device, the method including supplying scan signals and data signals to pixels including first pixels and second pixels in a pixel area, concurrently or substantially simultaneously supplying a first emission control signal to the first pixels after the scan signals and the data signals are supplied to the pixels, and concurrently or substantially simultaneously supplying a second emission control signal to the second pixels after supplying the first emission control signal.

The method may further include supplying an initialization control signal to the pixels such that an initialization power is supplied to anode electrodes of organic light-emitting diodes in the pixels.

Supplying the initialization control signal may include supplying the initialization control signal after the scan signals and the data signals are supplied to the pixels.

The first emission control signal may be supplied after the initialization control signal is supplied to the pixels.

Supplying the first emission control signal and supplying the second emission control signal may include supplying the first and second emission control signals such that a portion of a low level section of the first emission control signal overlaps a low level section of the second emission control signal.

DETAILED DESCRIPTION

Figure 1:
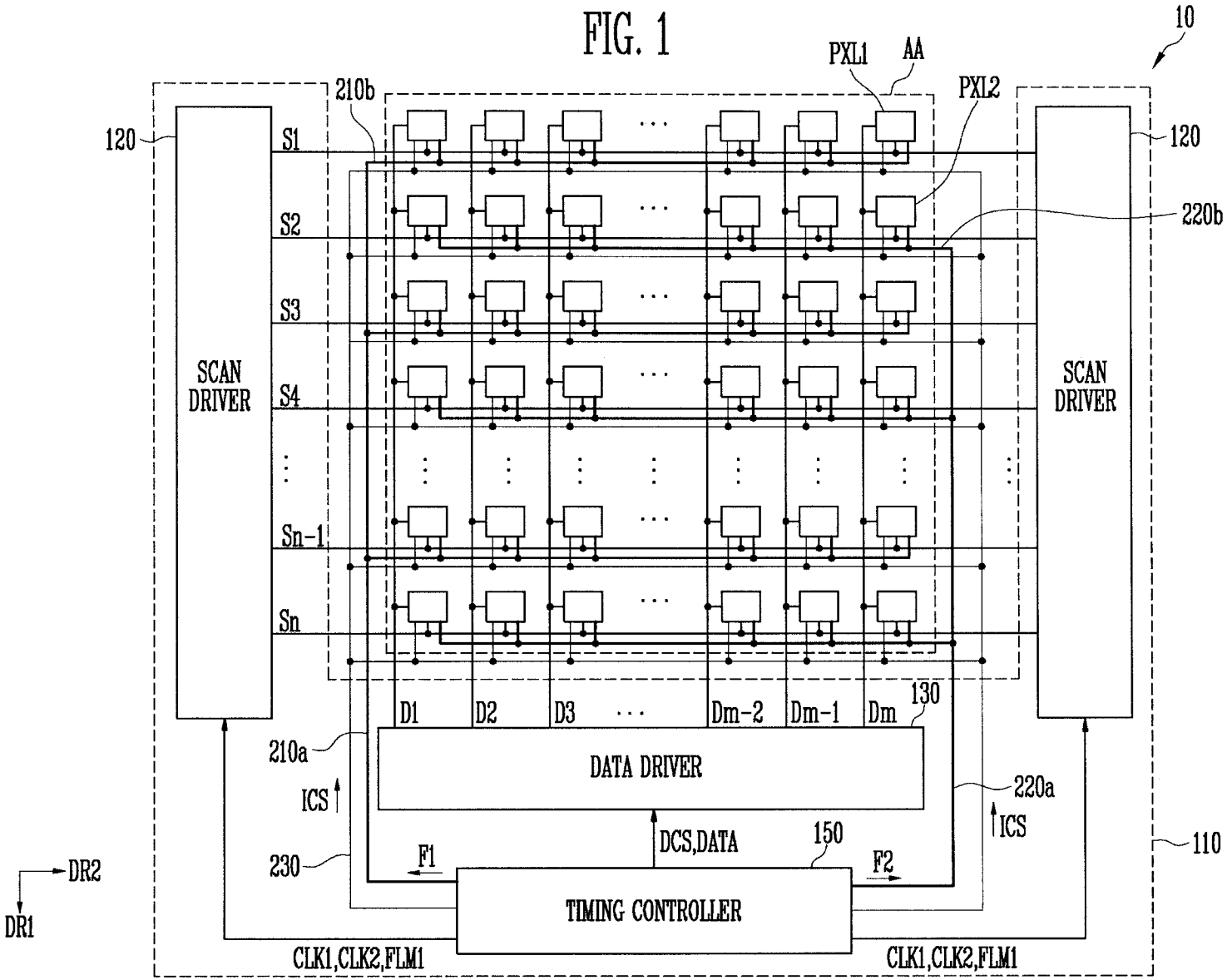
FIG. 1 is a diagram illustrating in detail the configuration of a display device in accordance with an embodiment of the present disclosure.

Features of the inventive concept and methods of accomplishing the same may be understood more readily by reference to the following detailed description of embodiments and the accompanying drawings. Hereinafter, embodiments will be described in more detail with reference to the accompanying drawings. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. Further, parts not related to the description of the embodiments might not be shown to make the description clear. In the drawings, the relative sizes of elements, layers, and regions may be exaggerated for clarity.

In the following description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. Similarly, when a first part is described as being arranged "on" a second part, this indicates that the first part is arranged at an upper side or a lower side of the second part without the limitation to the upper side thereof on the basis of the gravity direction.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

For the purposes of this disclosure, expressions such as "at least one of," when preceding a list of elements, modify the entire list of elements and do not modify the individual elements of the list. For example, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

When a certain embodiment may be implemented differently, a specific process order may be performed differently from the described order. For example, two consecutively described processes may be performed substantially at the same time or performed in an order opposite to the described order.

Various embodiments are described herein with reference to sectional illustrations that are schematic illustrations of embodiments and/or intermediate structures. As such, variations from the shapes of the illustrations as a result, for example, of manufacturing techniques and/or tolerances, are to be expected. Further, specific structural or functional descriptions disclosed herein are merely illustrative for the purpose of describing embodiments according to the concept of the present disclosure. Thus, embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting. Additionally, as those skilled in the art would realize, the described embodiments may be modified in various different ways, all without departing from the spirit or scope of the present disclosure.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Hereinafter, a display device and a method of driving the display device in accordance with embodiments of the present disclosure will be described with reference to the attached drawings pertaining to the embodiments of the present disclosure.

FIG. 1 is a diagram illustrating in detail the configuration of a display device 10 in accordance with an embodiment of the present disclosure.

Referring to FIG. 1, the display device 10 in accordance with an embodiment of the present disclosure may include pixel areas PXL1 and PXL2, and a display driver 110.

The display driver 110 may include a scan driver 120, a data driver 130, and a timing controller 150.

The pixels PXL1 and PXL2 may be in a pixel area AA, and may be coupled with respective ones of the scan lines S1 to Sn and data lines D1 to Dm. The pixels PXL1 and PXL2 may be arranged in the form of a matrix including a plurality of pixel rows extending in a first direction and a plurality of pixel columns extending in a second direction crossing the pixel rows. In other words, the pixel rows may include the pixels PXL1 and PXL2 that are arranged in the first direction, and the pixel columns may include the pixels PXL1 and PXL2 that are arranged in the second direction crossing the pixel rows.

In the present embodiment, although the pixels PXL1 and PXL2 have been illustrated as being arranged in the form of a matrix, the present disclosure is not limited thereto. The pixels PXL1 and PXL2 may be arranged in various forms. The first pixels PXL1 may be coupled to a first emission control line 210*a* and 210*b*, which may include a first sub-line 210*a* that is coupled to the timing controller 150 and extends in a first direction DR1, and second sub-lines 210*b* that are coupled to the first sub-line 210*a* and extend in a second direction DR2.

The first sub-line 210*a* may be on a first side of the pixel area AA.

Each of the second sub-lines 210*b* may be coupled to first pixels PXL1 on a corresponding pixel row.

The second pixels PXL2 may be coupled to a second emission control line 220*a* and 220*b*, which may include a third sub-line 220*a* that is coupled to the timing controller 150 and extends in the first direction DR1, and fourth sub-lines 220*b* that are coupled to the third sub-line 220*a* and extend in the second direction DR2.

The third sub-line 220*a* may be on a second side of the pixel area AA that is opposite to the first side of the pixel area AA on which the first sub-line 210*a* is located.

Each of the fourth sub-lines 220*b* may be coupled to second pixels PXL2 on a corresponding pixel row.

The second sub-lines 210*b* and the fourth sub-lines 220*b* may be alternately located. For instance, the second sub-lines 210*b* may be coupled to odd-numbered pixel rows, and the fourth sub-lines 220*b* may be coupled to even-numbered pixel rows. Therefore, the number of pixel rows coupled to the first emission control line 210*a* and 210*b* may be equal to or close to the number of pixel rows coupled to the second emission control line 220*a* and 220*b*.

The pixels PXL1 and PXL2 may be supplied with data signals from the data lines D1 to Dm when scan signals are supplied from the scan lines S1 to Sn to the pixels PXL1 and PXL2. Each of the pixels PXL1 and PXL2 that have been supplied with the data signals may control an amount of current flowing from a first power source ELVDD to a second power source ELVSS via an organic light-emitting diode. The organic light-emitting diode may generate light having a luminance corresponding to the amount of current.

The organic light-emitting diodes included in the first pixels PXL1 may concurrently or substantially simultaneously emit light in response to a first emission control signal F1 supplied through the first emission control line 210*a* and 210*b*. The organic light-emitting diodes included in the second pixels PXL2 may concurrently or substantially simultaneously emit light in response to a second emission control signal F2 supplied through the second emission control line 220*a* and 220*b*.

The display device 10 in accordance with an embodiment of the present disclosure may further include an initialization control line 230. The initialization control line 230 may be coupled to the first pixels PXL1 and the second pixels PXL2.

The scan driver 120 may supply scan signals to the scan lines S1 to Sn in response to scan driver control signals FLM1, CLK1, and CLK2 supplied from the timing controller 150.

For example, the scan driver 120 may successively supply scan signals to the scan lines S1 to Sn. When the scan signals are successively supplied, the pixels PXL1 and PXL2 may be successively selected on a pixel row basis.

In FIG. 1, there is illustrated an example in which parts of the scan driver 120 are on each of respective opposite sides of the pixel area AA, but the present disclosure is not limited to this. For example, the scan driver 120 may be provided on only a single side of the pixel area AA in other embodiments.

The data driver 130 may supply data signals to the data lines D1 to Dm in response to a data control signal DCS. The data signals supplied to the data lines D1 to Dm may be supplied to corresponding ones of the pixels PXL1 and PXL2 selected by the respective scan signals.

The timing controller 150 may supply the data control signal DCS to the data driver 130. The timing controller 150 may translate image data input from an external device into image data DATA corresponding to the specifications of the data driver 130, and may then supply the image data DATA to the data driver 130.

The data control signal DCS may include a source start signal, a source output enable signal, a source sampling clock, etc. The source start signal may control a point in time at which a data sampling operation of the data driver 130 starts. The source sampling clock may control the sampling operation of the data driver 130 based on a rising or falling edge. The source output enable signal may control the output timing of the data driver 130.

The timing controller 150 may supply, to the scan driver 120, scan driver control signals FLM1, CLK1, and CLK2 generated based on timing signals supplied from an external device. The scan driver control signals FLM1, CLK1, and CLK2 may include a first start signal FLM1 and clock signals CLK1 and CLK2. The first start signal FLM1 may control a supply timing of a first scan signal, and the clock signals CLK1 and CLK2 may be used to shift the first start signal FLM1.

The timing controller 150 may supply, to the first emission control line 210*a* and 210*b* and the second emission control line 220*a* and 220*b*, respectively, emission control signals F1 and F2 generated based on the timing signals supplied from the external device. The timing controller 150 may supply, to the initialization control line 230, an initialization control signal ICS generated based on the timing signals supplied from the external device.

The emission control signals F1 and F2, the initialization control signal ICS, and the scan signals may be set to a gate-on voltage (e.g., a low voltage) so that corresponding transistors included in the pixels PXL1 and PXL2 can be turned on.

In FIG. 1, there is illustrated an example in which the scan driver 120, the data driver 130, and the timing controller 150 are separately provided, but at least some of the foregoing components may be integrated with each other, as may be suitable, in other embodiments. The scan driver 120, the data driver 130, and the timing controller 150 may be installed using any one of various forms (e.g., a chip-on-glass form, a chip-on-plastic form, a tape carrier package form, and a chip-on-film form).

Figure 2:
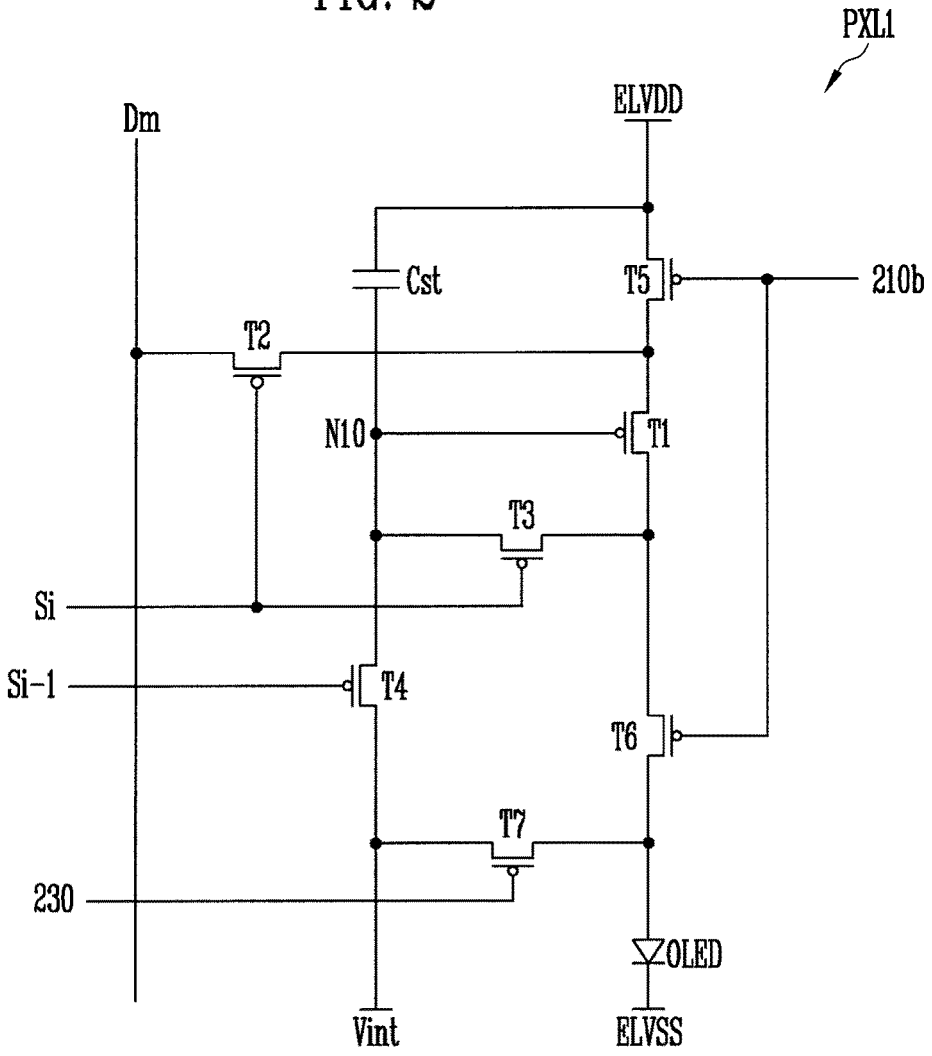
FIG. 2 is a diagram illustrating an embodiment of a first pixel shown in FIG. 1.

FIG. 2 is a diagram illustrating an embodiment of the first pixel PXL1 shown in FIG. 1.

In FIG. 2, for the sake of description, a first pixel PXL1 coupled to an m-th data line Dm and an i-th scan line Si will be illustrated. Referring to FIG. 2, the first pixel PXL1 in accordance with an embodiment of the present disclosure may include an organic light-emitting diode (OLED), first to seventh transistors T1 to T7, and a storage capacitor Cst.

An anode of the OLED may be coupled to the first transistor T1 via the sixth transistor T6, and a cathode thereof may be coupled to a second pixel power source ELVSS. The organic light-emitting diode OLED may generate light (e.g., light having a predetermined luminance) corresponding to current supplied from the first transistor T1.

A first pixel power source ELVDD may be set to a voltage that is higher than that of the second pixel power source ELVSS so that current can flow to the organic light-emitting diode OLED.

The seventh transistor T7 may be coupled between an initialization power source Vint and the anode of the organic light-emitting diode OLED. The seventh transistor T7 may be coupled to the initialization control line 230. When an initialization control signal is supplied through initialization control line 230, the seventh transistor T7 may be turned on so that the voltage of the initialization power source Vint may be supplied to the anode of the organic light-emitting diode OLED. The initialization power source Vint may be set to a voltage that is lower than that of a data signal.

The sixth transistor T6 may be coupled between the first transistor T1 and the organic light-emitting diode OLED. A gate electrode of the sixth transistor TR6 may be coupled to the second sub-line 210*b*. The sixth transistor T6 may be turned on when a first emission control signal is supplied to the second sub-line 210*b*, and may be turned off in other cases.

The fifth transistor T5 may be coupled between the first pixel power source ELVDD and the first transistor T1. A gate electrode of the fifth transistor TR5 may be coupled to the second sub-line 210*b*. The fifth transistor T5 may be turned on when the first emission control signal is supplied to the second sub-line 210*b*, and may be turned off in other cases.

A first electrode of the first transistor T1 (e.g., a driving transistor) may be coupled to the first pixel power source ELVDD via the fifth transistor T5, and a second electrode thereof may be coupled to the anode of the organic light-emitting diode OLED via the sixth transistor T6. A gate electrode of the first transistor T1 may be coupled to a first node N1. The first transistor T1 may control, in response to a voltage of the first node N1, the amount of current flowing from the first pixel power source ELVDD to the second pixel power source ELVSS via the organic light-emitting diode OLED.

The third transistor T3 may be coupled between a second electrode of the first transistor T1 and the first node N1. A gate electrode of the third transistor T3 may be coupled to the i-th scan line Si. When a scan signal is supplied to the i-th scan line Si, the third transistor T3 may be turned on so that the second electrode of the first transistor T1 can be electrically coupled with the first node N1. Therefore, when the third transistor T3 is turned on, the first transistor T1 may be connected in the form of a diode (e.g., diode-connected).

The fourth transistor T4 may be coupled between the first node N1 and the initialization power source Vint. A gate electrode of the fourth transistor T4 may be coupled to the i−1-th scan line Si−1. When a scan signal is supplied to the i−1-th scan line Si−1, the fourth transistor T4 is turned on so that the voltage of the initialization power source Vint can be supplied to the first node N1.

The second transistor T2 may be coupled between the m-th data line Dm and the first electrode of the first transistor T1. A gate electrode of the second transistor T2 may be coupled to the i-th scan line Si. When the scan signal is supplied to the i-th scan line Si, the second transistor T2 may be turned on so that the first electrode of the first transistor T1 can be electrically coupled with the m-th data line Dm.

The storage capacitor Cst may be coupled between the first pixel power source ELVDD and the first node N1. The storage capacitor Cst may store a voltage corresponding to both a data signal and a threshold voltage of the first transistor T1.

The second pixel PXL2 may be embodied by the same circuit as that of the first pixel PXL1, with the exception that the second pixel PXL2 is coupled to the fourth sub-line 220*b* and is supplied with the second emission control signal F2 (instead of being coupled to the second sub-line 210*b* to be supplied with the first emission control signal F1). Therefore, detailed description of the second pixel PXL2 will be omitted.

The pixel structure illustrated in FIG. 2 is only one example, so that the pixels PXL1 and PXL2 of the present disclosure are not limited to the foregoing pixel structure. Substantially, each pixel has a circuit structure capable of supplying current to the organic light-emitting diode OLED, and any one of various well-known structures may be selected as the structure of the pixel.

In the present disclosure, the organic light-emitting diode OLED may generate light having various colors including red, green, and blue in response to current supplied from the driving transistor, but the present disclosure is not limited thereto. For instance, the organic light-emitting diode OLED may generate white light depending on the amount of current supplied from the driving transistor. In this case, a separate color filter or the like may be used to embody a color image.

Figure 3:
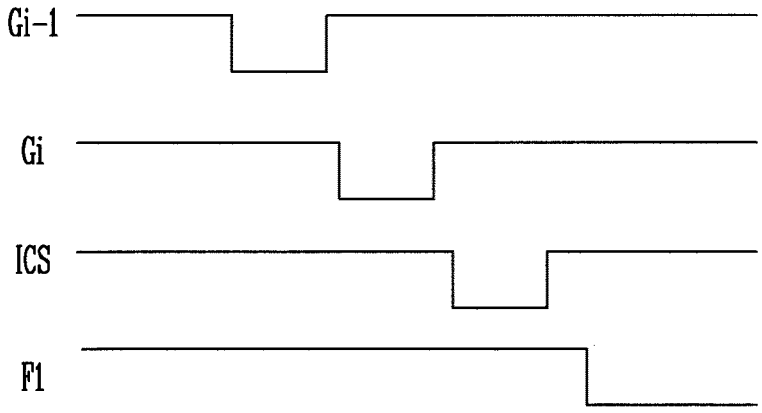
FIG. 3 is a diagram illustrating a method of driving the first pixel shown in FIG. 2.

FIG. 3 is a diagram illustrating a method of driving the first pixel shown in FIG. 2.

While the first emission control signal F1 is not supplied to the second sub-line 210*b* of the first emission control line, the fifth transistor T5 and the sixth transistor T6 are turned off. Here, the first pixel PXL1 may be set to a non-light-emitting state.

Subsequently, a scan signal Gi−1 is supplied to the i−1-th scan line Si−1 so that the fourth transistor T4 is turned on. If the fourth transistor T4 is turned on, the voltage of the initialization power source Vint is supplied to the first node N1. Then, the first node N1 may be initialized to the voltage of the initialization power source Vint.

After the first node N1 has been initialized to the voltage of the initialization power source Vint, a scan signal Gi is supplied to the i-th scan line Si. If the scan signal Gi is supplied to the i-th scan line Si, the second transistor T2 and the third transistor T3 are turned on.

When the third transistor T3 is turned on, the first transistor T1 is connected in the form of a diode. When the second transistor T2 is turned on, a data signal is supplied from the m-th data line Dm to the first electrode of the first transistor T1. Here, Because the first node N1 has been initialized to the voltage of the initialization power source Vint, which is lower than the data signal, the first transistor T1 may be turned on. When the first transistor T1 is turned on, a voltage formed by subtracting the threshold voltage of the first transistor T1 from the data signal is applied to the first node N1. The storage capacitor Cst stores a voltage corresponding to both the data signal applied to the first node N1 and the threshold voltage of the first transistor T1.

Subsequently, an initialization control signal ICS is supplied to the initialization control line 230. When the initialization control signal ICS is supplied, the seventh transistor T7 is turned on. When the seventh transistor T7 is turned on, the voltage of the initialization power source Vint is supplied to the anode electrode of the organic light-emitting diode OLED. Then, a parasitic capacitor that is parasitically formed in the organic light-emitting diode OLED is discharged, whereby the black expression performance may be enhanced.

Thereafter, a first emission control signal F1 is supplied to the second sub-line 210*b* of the first emission control line. When the first emission control signal F1 is supplied to the second sub-line 210*b*, the fifth transistor T5 and the sixth transistor T6 are turned on. Then, there is formed a current path extending from the first power source ELVDD to the second power source ELVSS via the fifth transistor T5, the first transistor T1, the sixth transistor T6, and the organic light-emitting diode OLED.

Here, the first transistor T1 may control, in response to the voltage of the first node N1, the amount of current flowing from the first power source ELVDD to the second power source ELVSS via the organic light-emitting diode OLED. The organic light-emitting diode OLED may emit light (e.g., light having a predetermined luminance) corresponding to the amount of current supplied from the first transistor T1.

Substantially, the first pixel PXL1 may repeatedly perform the above-mentioned process and thus generate light (e.g., light having a predetermined luminance). The second pixel PXL2 may be driven in the same manner as that of the first pixel PXL1, other than the fact that the second pixel PXL2 is supplied with the second emission control signal F2, instead of the first emission control signal F1, to emit light.

To make it possible for the pixels PXL1 and PXL2 to be set to the non-light-emitting state during a period in which data signals are charged to the pixels PXL1 and PXL2, the emission control signals F1 and F2 might not be supplied while the scan signals are supplied.

Figure 4:
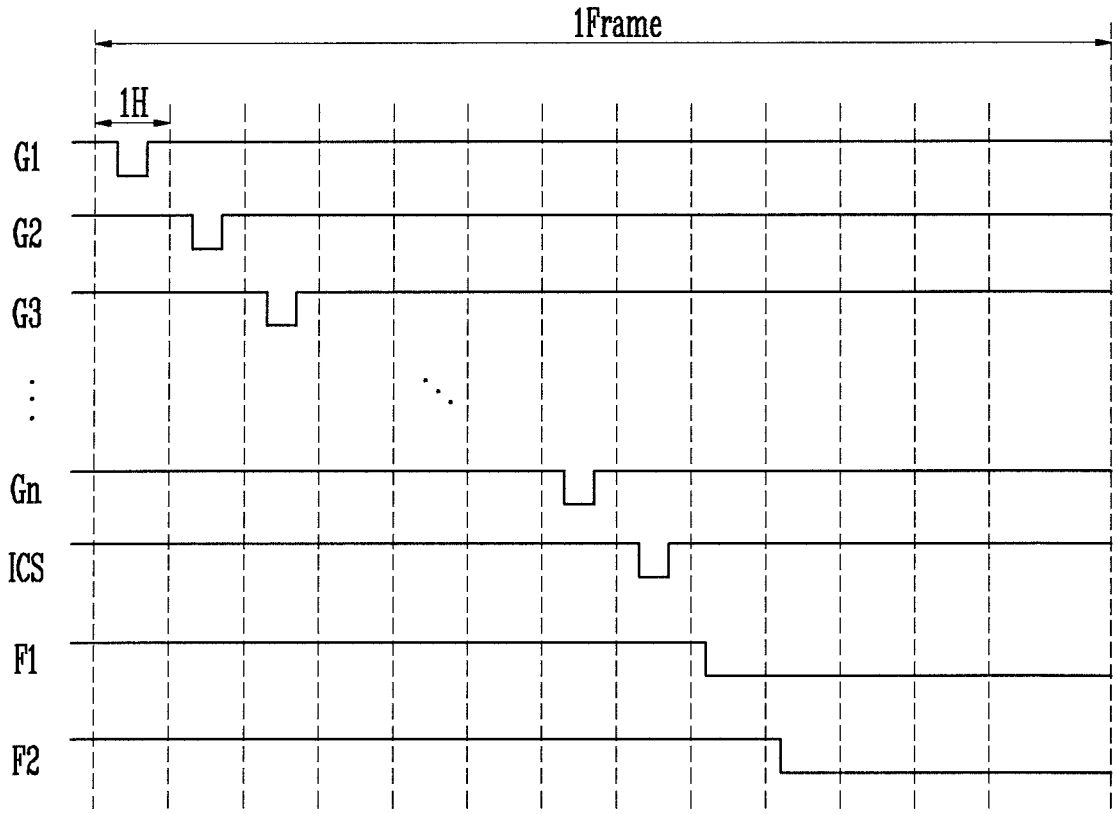
FIG. 4 is a diagram illustrating waveforms of scan signals, emission control signals, and an initialization control signal that are supplied to the pixels shown in FIG. 1.

FIG. 4 is a diagram illustrating waveforms of scan signals, emission control signals, and an initialization control signal that are supplied to the pixels shown in FIG. 1.

Referring to FIGS. 1 and 4, scan signals G1 to Gn may be successively supplied to the scan lines S1 to Sn, respectively. For example, the first scan signal G1 may be supplied to the first pixels PXL1 that are coupled to the first scan line S1. Thereafter, the second scan signal G2 may be supplied to the second pixels PXL2 that are coupled to the second scan line S2. The other scan lines G3 to Gn may be successively supplied to the corresponding pixels PXL1 and PXL2.

Here, the scan signals G1 to Gn may be successively supplied at an interval of one horizontal period 1H.

In FIG. 4, there is illustrated an example in which each of the scan signals G1 to Gn has one low level section, but the present disclosure is not limited to this. For instance, each of scan signals G1 to Gn may include a plurality of low level sections supplied to the pixels PXL1 and PXL2.

After the n-th scan signal Gn has been supplied to the second pixels PXL2 that are coupled to the n-th scan line Sn, the initialization control signal ICS may be supplied to the pixels PXL1 and PXL2.

The initialization control signal ICS may be concurrently or substantially simultaneously supplied to the pixels PXL1 and PXL2, so that the voltage of the initialization power source Vint may be concurrently or substantially simultaneously supplied to the anode electrodes of the organic light-emitting diodes OLED included in the pixels PXL1 and PXL2.

If, unlike an embodiment of the present disclosure, initialization control signals are successively supplied to the pixels along the pixel rows and, thereafter, the pixels concurrently or substantially simultaneously emit light, the amounts of charges charged to parasitic capacitors formed in the organic light-emitting diodes may differ from each other depending on the positions of the pixels. Consequently, a difference in luminance between the pixels may be caused.

Contrastingly, in the display device in accordance with the present embodiment, the initialization power Vint may be concurrently or substantially simultaneously supplied to the anode electrodes of the organic light-emitting diodes OLED provided in the pixels PXL1 and PXL2, whereby the above problem can be solved.

In FIG. 4, there is illustrated an example in which the n-th scan signal Gn is supplied and, after one horizontal period 1H has passed, the initialization control signal ICS is supplied, but the present disclosure is not limited to this. A time interval between the point in time at which the n-th scan signal Gn is supplied and the point in time at which the initialization control signal ICS is supplied may be changed in various ways.

After the initialization control signal ICS has been supplied to the pixels PXL1 and PXL2, the first emission control signal F1 is supplied to the first pixels PXL1. Because the first emission control signal F1 is concurrently or substantially simultaneously supplied to the first pixels PXL1, the first pixels PXL1 may concurrently or substantially simultaneously emit light.

The first emission control signal F1 is supplied to the first pixels PXL1 and, after a predetermined time has passed, the second emission control signal F2 may be supplied to the second pixels PXL2. Because the second emission control signal F2 is concurrently or substantially simultaneously supplied to the second pixels PXL2, the second pixels PXL2 may concurrently or substantially simultaneously emit light.

A time interval between the point in time at which the first emission control signal F1 is supplied, and the point in time at which the second emission control signal F2 is supplied, may be one horizontal period 1H.

A portion of the low level section of the first emission control signal F1 may overlap the low level section of the second emission control signal F2 so that the first pixels PXL1 and the second pixels PXL2 may concurrently or substantially simultaneously emit light (e.g., for a predetermined period of time).

If, unlike an embodiment of the present disclosure, a data signal is supplied to the pixels and, thereafter, the pixels concurrently or substantially simultaneously emit light, the supply of the emission control signal to the pixels may be delayed because of a load value by the emission control lines, thus causing a problem in that the light-emitting period of the pixels is reduced.

Furthermore, in the case where the display device is increased in resolution or size, a comparatively large current momentarily flows through the display driver that outputs an emission control signal, whereby the display driver may malfunction.

Contrastingly, in the present embodiment, the number of pixel rows that are concurrently or substantially simultaneously supplied with the emission control signal is reduced by half. Consequently, the above-mentioned problems can be solved.

For instance, in the present embodiment, the first pixels PXL1 on the odd-numbered pixel rows first emit light and, after one horizontal period 1H has passed, the second pixels PXL2 on the even-numbered pixel rows concurrently or substantially simultaneously emit light. In this way, the above-mentioned problems can be solved.

Because the eyes of the human perceive an average luminance of an image displayed for one frame, the visibility does not deteriorate even when the simultaneous light-emitting operation of the first pixels PXL1 on the odd-numbered pixel rows is performed separately from the simultaneous light-emitting operation of the second pixels PXL2 on the even-numbered pixel rows.

Figure 5:
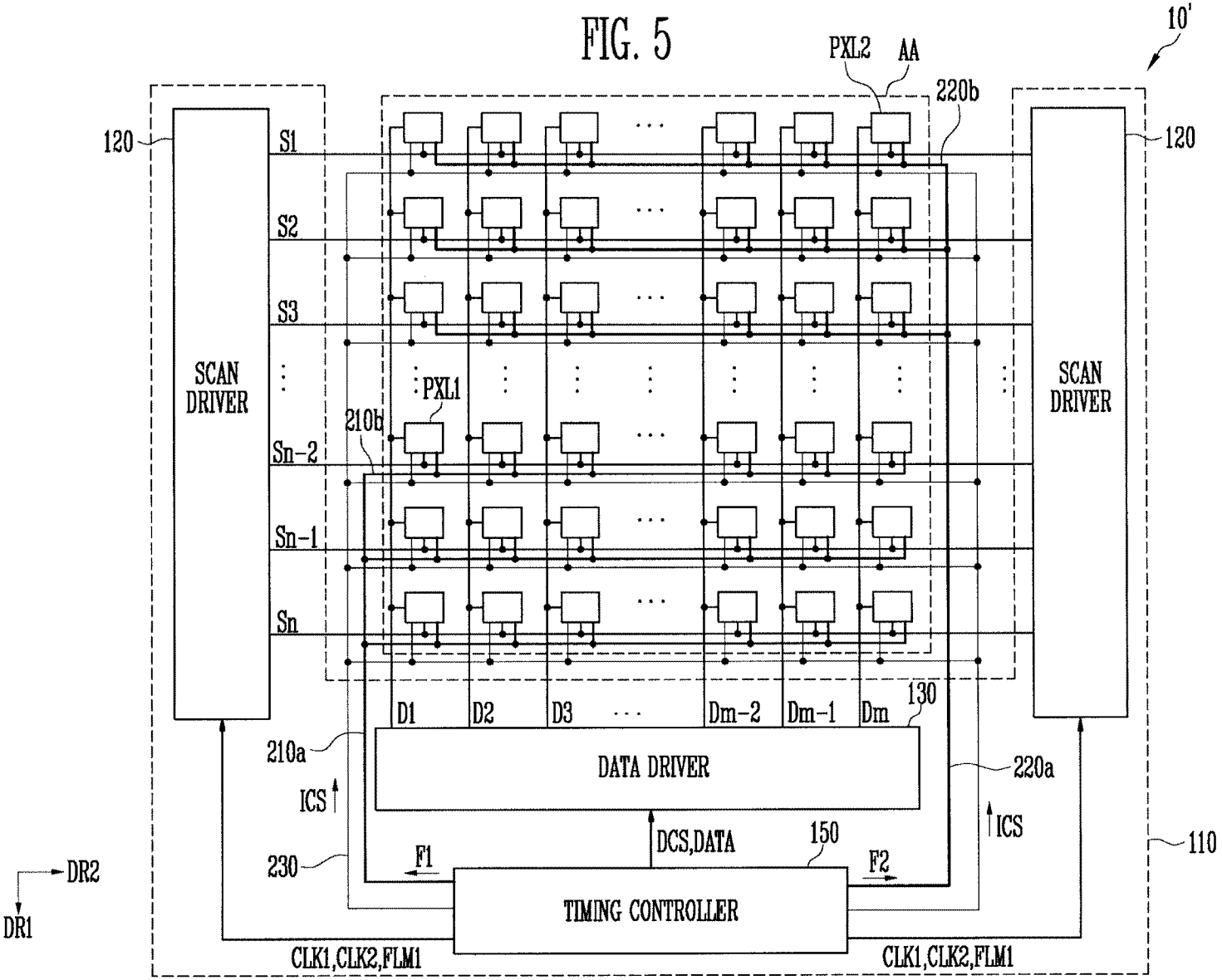
FIG. 5 is a diagram illustrating in detail the configuration of a display device in accordance with an embodiment of the present disclosure.

FIG. 5 is a diagram illustrating in detail the configuration of a display device 10' in accordance with an embodiment of the present disclosure.

In the following description of the display device 10' shown in FIG. 5, repeated detailed descriptions of parts that are the same as those of the display device 10 of FIG. 1 will be omitted, and the description will be focused on differences therebetween.

Referring to FIG. 5, the display device 10' in accordance with an embodiment of the present disclosure may include pixels PXL1 and PXL2, and a display driver 110.

The display driver 110 may include a scan driver 120, a data driver 130, and a timing controller 150.

The pixels PXL1 and PXL2 may be in a pixel area AA, and may be coupled with corresponding scan lines S1 to Sn and data lines D1 to Dm.

The first pixels PXL1 may be coupled to a first emission control line 210*a* and 210*b*, which may include a first sub-line 210*a* and second sub-lines 210*b*. The first sub-line 210*a* may be coupled to the timing controller 150, and may extend in a first direction DR1. The first sub-line 210*a* may be on a first side of the pixel area AA. The second sub-lines 210*b* may be coupled to the first sub-line 210*a*, and may extend in a second direction DR2. Each of the second sub-lines 210*b* may be respectively coupled to first pixels PXL1 on a corresponding pixel row.

The second pixels PXL2 may be coupled to a second emission control line 220*a* and 220*b*, which may include a third sub-line 220*a* and fourth sub-lines 220*b*. The third sub-line 220*a* may be coupled to the timing controller 150, and may extend in the first direction DR1. The third sub-line 220*a* may be on a second side of the pixel area AA, which may be opposite to the first side of the pixel area AA on which the first sub-line 210*a* is located. The fourth sub-lines 220*b* may be coupled to the third sub-line 220*a*, and may extend in the second direction DR2. Each of the fourth sub-lines 220*b* may be coupled to respective second pixels PXL2 on a corresponding pixel row.

Half of the pixel rows in the pixel area AA may be coupled to the second sub-lines 210*b*, and the other half of the pixel rows may be coupled to the fourth sub-lines 220*b*.

For example, the fourth sub-lines 220*b* may be coupled to the pixel rows that are in an upper region of the pixel area AA, and the second sub-lines 210*b* may be coupled to the pixel rows that are in a lower region of the pixel area AA.

Therefore, the number of pixel rows coupled to the first emission control lines 210*a* and 210*b* may be equal to, or similar to, the number of pixel rows coupled to the second emission control lines 220*a* and 220*b*.

The pixels PXL1 and PXL2 may be supplied with data signals from the data lines D1 to Dm when scan signals are supplied from the corresponding scan lines S1 to Sn to the pixels PXL1 and PXL2.

The first pixels PXL1 may concurrently or substantially simultaneously emit light in response to a first emission control signal F1 supplied through the first emission control line 210*a* and 210*b*. The second pixels PXL2 may concurrently or substantially simultaneously emit light in response to a second emission control signal F2 supplied through the second emission control line 220*a* and 220*b*.

An initialization control line 230 may be coupled to the first pixels PXL1 and the second pixels PXL2.

The timing controller 150 may supply, to the initialization control line 230, an initialization control signal ICS generated based on timing signals supplied from an external device.

The timing controller 150 may respectively supply, to the first emission control line 210*a* and 210*b* and the second emission control line 220*a* and 220*b*, the first and second emission control signals F1 and F2 generated based on timing signals supplied from the external device.

The timing controller 150 may sequentially output the initialization control signal ICS, the first emission control signal F1, and the second emission control signal F2.

The display device 10 or 10' described with reference to FIGS. 1 to 5 may be a wearable display device (particularly, a head-mounted display device (hereinafter, referred to as "HMD")).

Figure 6A:
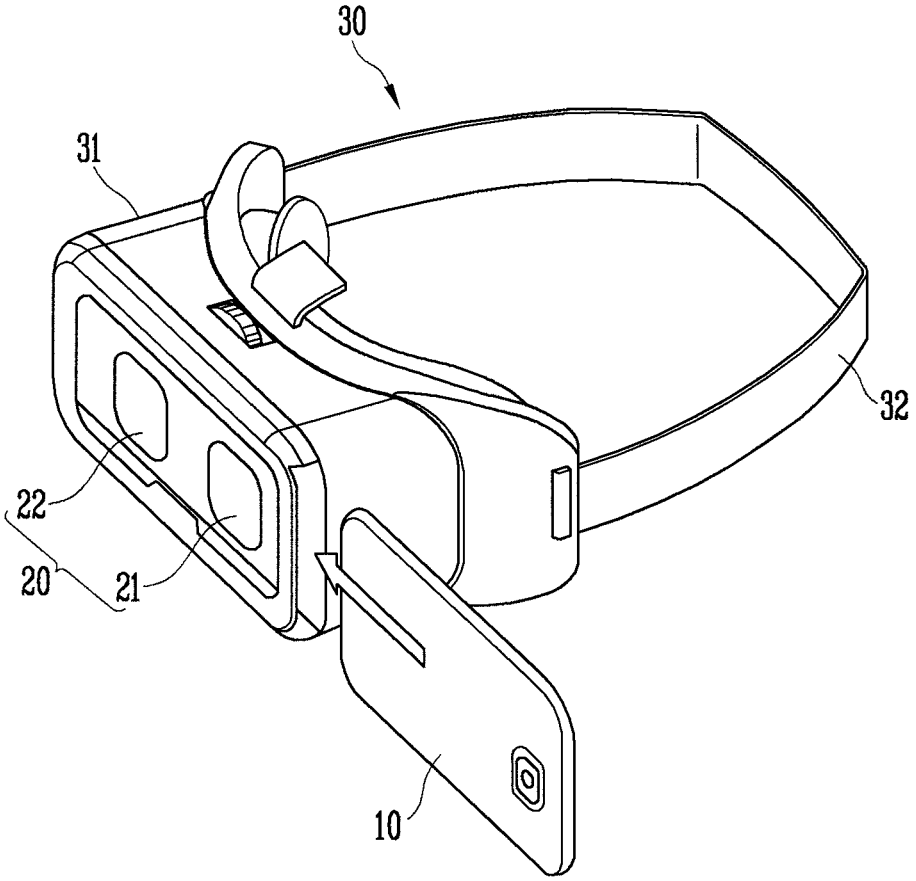
FIGS. 6A and 6B are diagrams illustrating a process of mounting the display device of FIG. 1 to a wearable device.
Figure 6B:
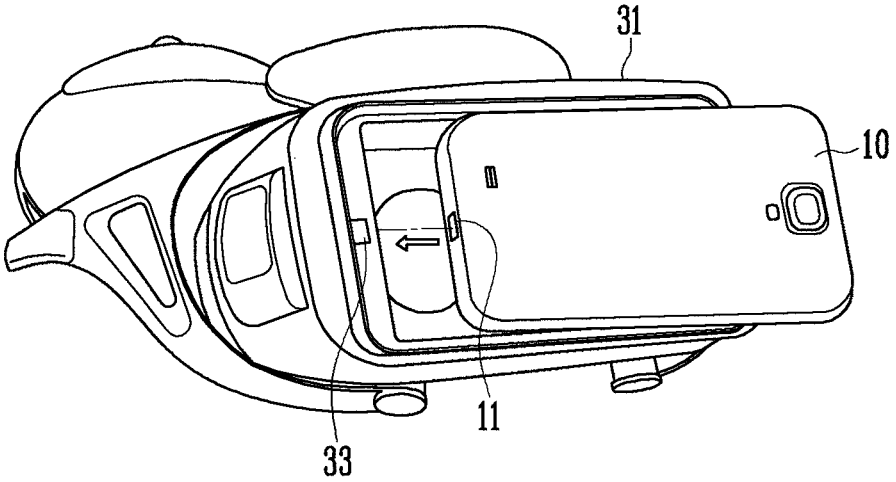

FIGS. 6A and 6B are diagrams illustrating a process of mounting the display device of FIG. 1 to a wearable device.

Although, in FIGS. 6A and 6B, an HMD is illustrated as an embodiment of the wearable device, the wearable device according to the present disclosure is not limited thereto.

Referring to FIGS. 6A and 6B, the wearable device 30 in accordance with an embodiment of the present disclosure may include a frame 31. The frame 31 may be coupled with a band 32. A user may wear the frame 31 on his/her head using the band 32. The frame 31 may have a structure allowing the display device 10 to be removably mounted thereto.

The display device 10, which can be mounted to the wearable device 30, may be a smartphone, but it is not limited thereto. However, the display device 10 may be not only a smartphone, but may also be any one of electronic devices such as a tablet PC, an electronic book reader, a computer, a workstation, a personal digital assistant (PDA), a portable multimedia player (PMP), and a camera, which may be mounted to the wearable device 30 and provided with a display unit.

When the display device 10 is mounted to the frame 31, a connector 11 of the display device 10 may be coupled with a connector 33 of the frame 31 so that the display device 10 may be electrically coupled to the wearable device 30. In other words, the wearable device 30 and the display device 10 may communicate with each other.

To control the display device 10 mounted to the frame 31, the wearable device 30 may include at least one of a touch sensor, a button, and a wheel key.

If the display device 10 is mounted to the wearable device 30, the display device 10 may be operated as an HMD.

For example, in the case where the display device 10 is mounted to the wearable device 30, the display device 10 may be driven in a first mode (e.g., a virtual reality (VR) mode). In the case where the display device 10 is removed from the wearable device 30, the display device 10 may be driven in a second mode (e.g., a normal mode).

The driving mode of the display device 10 may be automatically or manually converted. For example, if the display device 10 is mounted to the wearable device 30, the display device 10 may be automatically driven in the first mode, and if the display device 10 is removed from the wearable device 30, the driving mode of the display device 10 may be automatically converted from the first mode into the second mode. Contrastingly, the display device 10 may be operated in the first mode or the second mode according to manipulation of the user.

The wearable device 30 may include lenses 20 corresponding to the two eyes of the user. For example, the wearable device 30 may include a left lens 21 and a right lens 22 that respectively correspond to the left and right eyes of the user.

Alternatively, the wearable device 30 may include an integrated lens 20 to allow the user to concurrently or substantially simultaneously see the same image with his/her left and right eyes.

Each lens 20 may be an fish-eye lens or a wide-angle lens so as to increase a field of view (FOV) of the user, but it is not limited thereto.

If the display device 10 is fixed to the frame 31, the user may watch, through the lens 20, an image displayed on the display device 10. Hence, this may have the same effect as if the user watches a large screen spaced apart from him/her by a predetermined distance.

Various embodiments of the present disclosure may provide a display device having improved display quality.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims, functional equivalents to be included therewith.

What is claimed is:

1. A display device comprising:

pixels comprising first pixels in two or more pixel rows spaced apart from each other, and second pixels in two or more other pixel rows spaced apart from each other, and located in a pixel area;

scan lines coupled with the pixels, and configured to supply scan signals to the pixels;

a first emission control line electrically coupled to all of the first pixels, and configured to concurrently supply a first emission control signal to all of the first pixels;

a second emission control line electrically coupled to all of the second pixels, and configured to concurrently supply a second emission control signal to all of the second pixels; and a display driver configured to supply the first emission control signal to the first emission control line before supplying the second emission control signal to the second emission control line, and wherein all of the first pixels concurrently emit light based on the first emission control signal, and all of the second pixels concurrently emit light based on the second emission control signal.

2. The display device according to claim 1, wherein the display driver is configured to supply the first emission control signal to the first emission control line after the scan signals are supplied to the first and second pixels.

3. The display device according to claim 2, further comprising an initialization control line coupled to the pixels, and configured to supply an initialization control signal to the pixels via the initialization control line such that an initialization power is supplied to anode electrodes of organic light-emitting diodes in the pixels.

4. The display device according to claim 3, wherein the display driver is configured to supply the initialization control signal to the initialization control line after the scan signals are supplied to the pixels.

5. The display device according to claim 4, wherein the display driver is configured to supply the first emission control signal to the first emission control line after the initialization control signal is supplied to the initialization control line.

6. The display device according to claim 1, wherein the display driver is configured to supply the first and second emission control signals such that a portion of a low level section of the first emission control signal overlaps a low level section of the second emission control signal.

7. The display device according to claim 1, wherein the first emission control line comprises a first sub-line coupled with the display driver and extending in a first direction, and second sub-lines coupled to the first sub-line and extending in a second direction crossing the first direction, wherein the second emission control line comprises a third sub-line coupled with the display driver and extending in the first direction, and fourth sub-lines coupled to the third sub-line and extending in the second direction, wherein the first sub-line is on a first side of the pixel area, and wherein the third sub-line is on a second side of the pixel area that is opposite to the first side.

8. The display device according to claim 7, wherein the second sub-lines and the fourth sub-lines are arranged alternately along the first direction.

9. The display device according to claim 7, wherein a number of second sub-lines is equal to a number of fourth sub-lines.

10. A method of driving a display device, the method comprising:

supplying scan signals and data signals to pixels comprising first pixels in two or more pixel rows spaced apart from each other, and second pixels in two or more other pixel rows spaced apart from each other, and located in a pixel area;

concurrently supplying a first emission control signal to all of the first pixels after the scan signals and the data signals are respectively supplied to all of the pixels; and concurrently supplying a second emission control signal to all of the second pixels after supplying the first emission control signal, and wherein all of the first pixels concurrently emit light based on the first emission control signal, and all of the second pixels concurrently emit light based on the second emission control signal.

11. The method according to claim 10, further comprising supplying an initialization control signal to the pixels such that an initialization power is supplied to anode electrodes of organic light-emitting diodes in the pixels.

12. The method according to claim 11, wherein supplying the initialization control signal comprises supplying the initialization control signal after the scan signals and the data signals are supplied to the pixels.

13. The method according to claim 12, wherein the first emission control signal is supplied after the initialization control signal is supplied to the pixels.

14. The method according to claim 10, wherein supplying the first emission control signal and supplying the second emission control signal comprises supplying the first and second emission control signals such that a portion of a low level section of the first emission control signal overlaps a low level section of the second emission control signal.

15. A display device comprising:

pixels comprising first pixels in two or more adjacent rows of the pixels, and second pixels in two or more other adjacent rows of the pixels, and located in a pixel area;

scan lines coupled with the pixels, and configured to supply scan signals to the pixels;

a first emission control line electrically coupled to all of the first pixels, and configured to concurrently supply a first emission control signal to all of the first pixels;

a second emission control line electrically coupled to all of the second pixels, and configured to concurrently supply a second emission control signal to all of the second pixels; and a display driver configured to supply the first emission control signal to the first emission control line before supplying the second emission control signal to the second emission control line, and wherein all of the first pixels concurrently emit light based on the first emission control signal, and all of the second pixels concurrently emit light based on the second emission control signal.

* * * * *